United States Patent [19]

Coffaro et al.

[11] 4,226,414

[45] Oct. 7, 1980

[54] WEIGHT EXERCISE DEVICE

[76] Inventors: Matthew Coffaro, 4190 Sierra Chapita, Tucson, Ariz. 85715; Ronald L. Pelton, 7402 E. Thirty-Eighth St., Tucson, Ariz. 85730

[21] Appl. No.: 898,091

[22] Filed: Apr. 20, 1978

[51] Int. Cl.[3] ..... A63B 23/00

[52] U.S. Cl. ..... 272/117; 272/144

[58] Field of Search ..... 272/117, 134, 93, 118, 272/135, 144

[56] References Cited

U.S. PATENT DOCUMENTS

| | | | |
|---|---|---|---|
| 458,382 | 8/1891 | Zander | 272/117 |
| 2,305,548 | 12/1942 | Nichols | 272/126 |
| 2,921,791 | 1/1960 | Berne | 272/117 |
| 3,115,339 | 12/1963 | Forte | 272/117 |
| 3,118,668 | 1/1964 | Callahan | 272/123 |
| 3,306,611 | 2/1967 | Gaul | 272/118 |
| 3,373,993 | 3/1968 | Oja | 272/118 |
| 3,558,130 | 1/1971 | Anderson | 272/117 |
| 3,640,527 | 2/1972 | Procter | 272/118 |
| 3,815,903 | 6/1974 | Bloomqvist | 272/118 |
| 4,010,947 | 3/1977 | Lambert | 272/118 |

*Primary Examiner*—Richard J. Johnson
*Attorney, Agent, or Firm*—J. Michael McClanahan

[57] ABSTRACT

A weight exercise device for a person exercising the arms when in a standing, croutched, or sitting position comprising upright legs with weights pivotally attached to one end of the legs and on one side of the legs, a pivotal fulcrum-lever assembly attached to the legs at the opposite end and on the opposite side of the legs as the weights, the pivot fulcrum-lever assembly also attached to the weights, and handle means attached to the fulcrum-lever assembly means whereby a person may grasp the handle means attached to the fulcrum-lever assembly and by pulling on same, lift the attached weight means, and thereby exercise the arms, shoulders, and chest, lats and strengthen all upper torso and stomach muscles.

8 Claims, 3 Drawing Figures

WEIGHT EXERCISE DEVICE

BACKGROUND OF THE INVENTION

Many devices have been made and patented dealing with the sport of exercising parts of the human body by lifting weights. These devices have been relatively complex requiring the use of a plurality of pulleys, cables, and levers which, due to their construction, require that the exercise devices be attached to walls or that there be a permanent type of attachment of the device to the floor. Additionally, in some cases, a large stable platform may be constructed which sets on the floor, the weight of the platform being such that it exceeds the weights and forces which are directly involved in the exercise. The reason these exercise devices must be attached to the wall or floor is that the devices exert forces in directions other than towards the ground or floor.

For example, U.S. Pat. No. 3,815,903 illustrates a weight lifting exercising device which comprises a plurality of cables and pulleys and which is attached to a vertical wall because of the arrangement of the weights and directions which the cables are pulled over the pulleys. Similarly, U.S. Pat. No. 3,640,527, 4,010,947, and 3,373,993 illustrate exercising devices which depend upon a large stable floor resting platform in order to provide the necessary inherent stability when being used. Other devices are available, such as illustrated in U.S. Pat. No. 3,306,611 which provides that the device be anchored to the floor, again for the purpose that forces are directed in other directions than towards the floor, here an upward direction.

It is obvious that the exercising devices which have been aforementioned, in addition to requirements for special wall or floor supports, are relatively large cumbersome devices which may not be placed easily out of sight or stored in a small area when not in use. Thus, it is apparent then that there is need for a weight exercising device which is rather compact and portable and which does not depend upon attachment to floors or to walls to be used but which in fact is so arranged that the forces exerted by the machine when in operation are towards the floor and where the device need not be anchored.

SUMMARY OF THE INVENTION

In accordance with the present invention, a weight exercise device is shown and described where a pair of upright legs provide the ground support for a fulcrum of a lever whereby on one side of the lever, weights may be attached and on the other side the operator exerts downward force to lift the weights. The weights are attached at a distance from the bottom of the legs at the distal end of a pivotal arm, the arm being in pivotal relationship with the legs, an extension connecting one end of the lever to the weighted end of the pivotal arm. The other end of the lever is connected to a chain attached to a handle for holding by the operator, the operator then pulling down the handle and thereby lifting the weights. The forces due to the weights and operator are so distributed and the fulcrum of the lever assembly so placed, together with the length of the lever assembly, that there are essentially no forward, back, or side to side forces exerted by the machine and that substantially all forces exerted by the machine are downward through the legs. When in operation, the device's legs will incline slightly forward or back until the sum of all horizontal forces are zero. Thus, inherent stability of the machine is achieved and there is no requirement that the machine be attached to a vertical wall, that it be attached to the floor, or that a large ground platform be employed.

In addition, the machine may be very simply and readily attached to a bench rest as desired and thereby provide means by which the operator can operate the weight exercising device from a sitting or lying position.

Accordingly, it is an object of the present invention to provide a weight exercising device which does not require attachment to walls or to the floors, but which is balanced about its legs so that substantially no force is exerted in any direction other than downward.

Further it is another object of the subject invention to provide a weight exercising device whereby a person can strengthen their arms in pulling down.

It is still another object of the subject invention to provide a weight lifting device which may be readily attached to existing bench rests for additional exercises.

DETAILED DESCRIPTION OF PREFERRED EMBODIMENT

Figure 1:
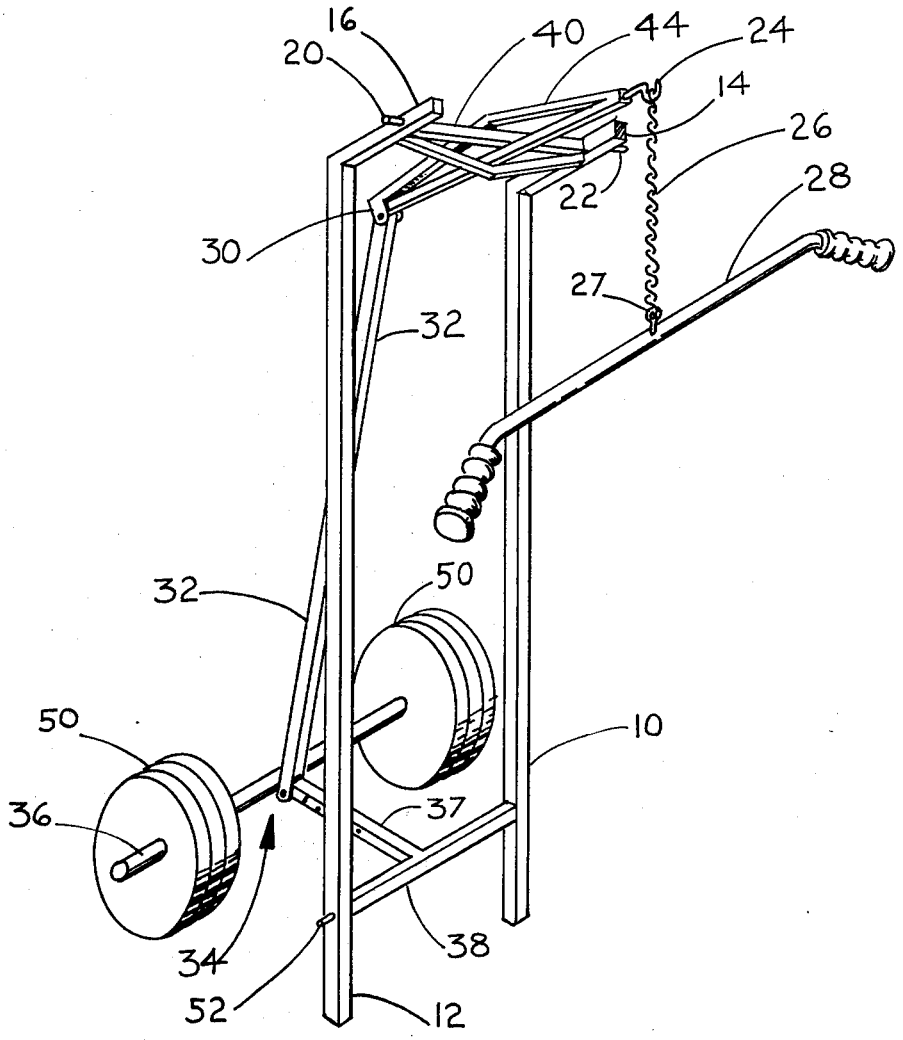
FIG. 1 is a perspective view of the subject invention.

Referring now to FIG. 1, the preferred embodiment of the weight exercise device is detailed. Primarily, the invention comprises two upright legs 10 and 12 which rise from the floor on which the device sets a distance of four to five feet, at which point short extension arms 14 and 16 respectively are attached. Coupled between the top extension arms 14 and 16 of upright legs 10 and 12 is the pivotal fulcrum-lever assembly 18. Fulcrum-lever assembly 18, which comprises at least two, but preferably four, joined together pieces, and which is shown in more detail in FIG. 2, pivotally attaches to extension arms 14 and 16 by pivot pin 20 through a hole formed in the extension arm and pivot pin 22 penetrating extension arm 14, both pivot pins 20 and 22 attached to the horizontal cross member 40 of the fulcrum-lever assembly 18 (see FIG. 2). Attached at one end of top cross member 44 of the fulcrum-lever assembly 18 which joins the extension arm is hook 24 which in turn is attached to handle chain 26. Attached by means of eye bolt 27 to handle chain 26 is handle 28 which the person utilizing the exercise device holds when exercising.

At the opposite end of the fulcrum-lever assembly 18 top member 44 from the hook 24 is saddle shaped coupling 30 which attaches to the two members of the fulcrum-lever assembly 18 there joined and which provides, at its parallel bifurcated ends, a pin which engages an opening in weight extension rod 32. Weight extension rod 32 connects at its opposite end with cross bar assembly 34. Cross bar assembly 34 comprises cross bar 36, cross arm 38, and extension 37. In the configuration of the invention shown in FIG. 1, weight extension rod 32 has a central portion removed from the lower end to form two parallel ears which attach to both sides of extension 37, there being a pin between the ears of the weight extension rod 32 passing through one of a plurality of differently spaced openings in extension 37. As can be seen, cross arm 38 additionally has pivot pins 52 and 54 (not shown) at opposite ends, the pivot pins penetrating opposite openings in legs 10 and 12.

Residing on cross bar 36 are selected removable weights 50, which are nominally made from cast iron and have a specific weight.

In operation, the operator may be standing up, sitting, or croutched in a position beneath the handle 28 whereupon he reaches up and grabs handle 28 on both ends by its handle grips and pulls it down. His pulling force transfers to the fulcrum-lever assembly 18, levering about cross member 40 held in place by the pivot pins through the extension arms of the upright legs, and the opposite end of the fulcrum-lever assembly lifts, by means of the weight extension rod 32, the cross bar assembly 34. As weight 50 is lifted by the upward force exerted on weight extension rod 32, cross arm 38, through its attached pivot pin 52, rotates in position. When the operator wishes to return the weights to their resting position, he merely lets up on handle 28. The relative vertical position of the legs, because of the moment formed by the fulcrum-lever assembly upon the extension arms, will move to a position where the sum of the horizontal forces is zero and that the forces exerted will be on the floor in the direction of the legs. The legs will thus be slightly inclined.

Figure 2:
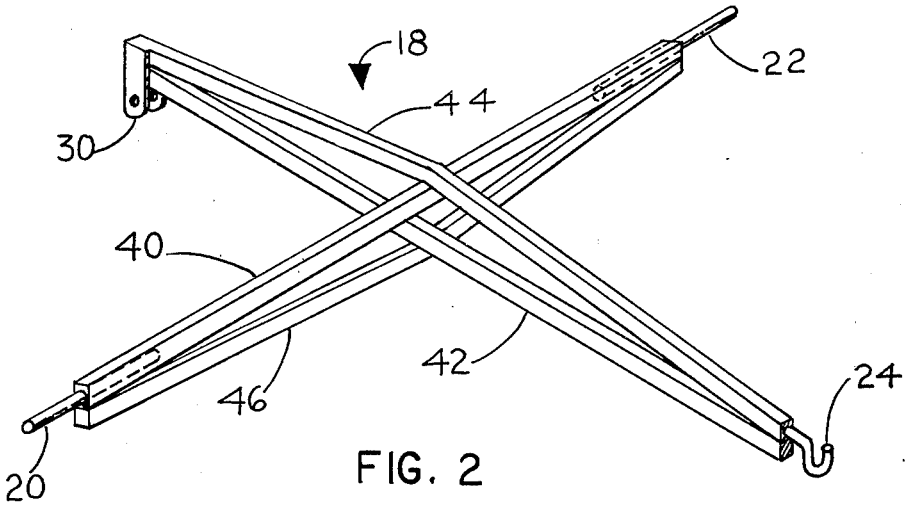
FIG. 2 is a perspective view of the fulcrum-lever assembly portion of the invention.

Referring now to FIG. 2, an enlarged view of the fulcrum-lever assembly 18 is detailed. In the preferred embodiment, the fulcrum-lever assembly 18 comprises four major pieces of square steel tubing which has been bent to a shallow V-shape. Primarily, cross member 40, which runs between the legs extension arms 16 and 14, is a solid piece of square tubing having pivot pins 20 and 22 pressed into the ends and then welded or otherwise held in place. In fact, the use of self tapping threads on the pivot pins may be employed and then the pins are screwed into the hollow interior of the cross member. Similarly, lengthwise member 42 is a solid piece of square steel tubing which crosses cross member 40 at right angles and at piece's centers. Serving to add strength to the combination of the two members 40 and 42, are top member 44 and bottom member 46. In the preferred embodiment, top member 44 joins lengthwise member 42 at its ends and the center of top member 44 is bent to form a slight V-shaped member which in turn is brought down over cross member 40 and its ends joined with the ends of lengthwise member 42. Similarly, bottom member 46 is formed as was top member 44 with its end joined with the ends of cross member 40. Thereafter, all pieces are appropriately attached with adhesive or, as in the preferred embodiment, welded. This would include the slight V-shaped top member 44 as well as bottom member 46 and then all members, where they touch at the center, are joined one to another by welding. Hook 24 is inserted into the hollow center of top member 44 at one end and attached by welding or for that matter, by having self tapping threads on the hook shank portion and screwing the hook into the top member 44. It is noted at this point that the upright legs 10 and 12, which have their respective extension arms 14 and 16 attached, may also be constructed by cutting a V-shaped notch into each leg and then bending about the remaining side until the sides of the notch once more join each other. Then a weld bead is run around the three joined sides, the legs being constructed of steel in the preferred embodiment.

Similarly, the cross bar assembly 34 shown in FIG. 1 is formed by butt welding one end of short extension 37 to the center of one side of cross arm 38 and at its opposite end, welded to the center periphery of the cross bar 36. Pivot pins 52 and 54 (not shown) also attach to the cross arm 38 by inserting into the hollow center of the square steel tubing, securing by welding on self tapping screw threads.

Figure 3:
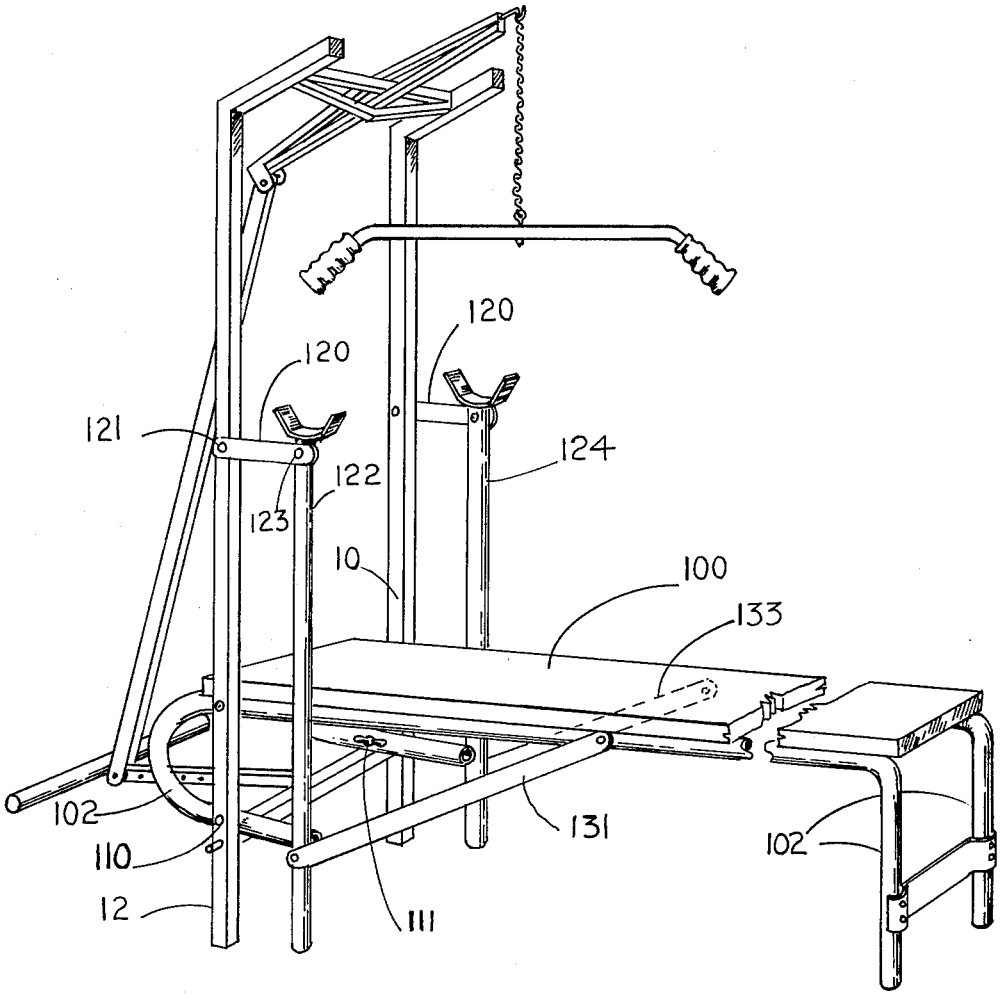
FIG. 3 is a perspective view of the subject invention attached to a bench rest.

Referring now to FIG. 3, a perspective view of the subject invention when used in combination with a bench rest is shown. Here, the invention's upright legs 12 and 10 attach to bench rest 100 at three points on each leg, two of which points are on the tubing 102 which forms the bench rest rear legs and which runs longitudinally beneath the length of the top surface of bench rest 100, and then at its front end doubles under to form a modified semicircle. It is at the point where the tubing 102 forms the semi-circle that each piece of tubing 102 crosses each leg at two points. At these points, holes drilled through the tubing 102 and the legs 10 and 12 receive bolts 110 and 112 (not shown). Opposite bolt 110 shown in FIG. 3 is wing-nut 111 which screws on the threaded portion of the bolt 112. Both bolts receive wing-nuts.

Above the two lower joinder points on each leg of the invention, another joinder of the invention to the bench rest is made by a bracket 120 which joins the bench rest uprights 122 and 124 to the legs 10 and 12. The bench rest uprights have U-shaped brackets attached at their top to receive the central bar of the weight barbells (not shown). These uprights, number 122 and 124, also form, in their lower extension, the front legs of bench rest 100. The bracket 120, which attaches the upright leg 12 of the invention to the uprights 122 of the bench rest, is secured by bolts 121 and 123. Similar bolts are on the other leg and bench rest upright. Because of the proximity of these bolts to the hands of a person lying or sitting on the bench rest, it is suggested that rounded head bolts be employed as well as rounded head nuts in order that the person will not scrape their hands or their back.

Additionally shown on bench rest 100 are brace supports 131 and 133 which join the leg portions of uprights 122 and 124 at the same points that the tubing 102 joins the bench rest front legs. The other end of the brace supports join tubing 102 at the approximate center of the bench rest.

In operation, use of the invention in its preferred embodiment, either by itself or in combination with the bench rest, is as follows. When the invention is used by itself, with the placement of the weights on one side of the legs and the downward force being exerted at a point almost the same distance on the other side of the legs, the invention requires no sidewise support to keep it free standing. In fact the operator, in holding down on the weights can operate the whole invention without the invention walking, or by its falling one direction or the other. The operator grasps the handle at both ends and then, either in a sitting, standing, or croutching position can pull the handle down and lift the weights. This is repeated until the operator has decided he has sufficient amount of exercise. Of course the weights on the cross bar may be varied as desired and in an exercise program, over a period of time, the weights should be increased.

When the invention is used in combination with the bench rest, the invention is first attached to the bench uprights and tubing comprising the bench rest. Thereafter, the operator may either sit or lie down on the bench rest and reach up and grab the handle, and the same pull down exercises are accomplished as when the device was by itself. Again a progressive program increasing the weights is the suggested format.

While a preferred embodiment of the invention has been shown and described, it would be understood that there is no intent to limit the invention by such disclosure, but rather, it is intended to cover all modifications and alternate constructions falling within the spirit and the scope of the invention as defined in the appended claims.

We claim:

1. A weight exercise device comprising an interacting pair of normally unstable standing, upright, elongated and spaced apart parallel legs having at each of their top ends thereof attached at right angles thereto a horizontal leg extension means; a lever assembly having two ends, said lever assembly also defining transverse cross bar means, said cross bar means pivotally attached to said legs, said leg extension means receiving said cross bar means to provide a fulcrum for said lever assembly; weight assembly means operably attached to a first end of said lever assembly; and operator holding means operably attached to the second end of said lever assembly whereby the unstable standing legs achieve stability when the operator grasps and pulls the operator holding means and thereby causes interaction of the legs, lever assembly, weight assembly means, and operator holding means to perform exercises.

2. The weight exercise device as defined in claim 1 wherein said lever assembly comprises at least two elongated pieces, the first of said elongated pieces defining said transverse cross bar means, and the second of said elongated pieces comprising lever means having said first and second ends, said first and second pieces attached together at right angles.

3. The weight exercise device as defined in claim 2 wherein said lever assembly comprises third and fourth elongated strengthening pieces, said third piece running generally along said first piece and attached to the ends thereof, and said fourth piece running generally along said second piece and attached to the ends thereof.

4. The weight exercise device as defined in claim 1 wherein said weight assembly means comprises means to receive and hold individual weights, and pivotal means operably attached between said pair of unstable standing legs, said weight receiving means and said pivotal means attached by interconnecting arm means whereby said weight receiving means may pivot at a distance about said pivotal means.

5. The weight exercise device as defined in claim 4 wherein said weight assembly means additionally comprises weight extension rod means, said weight extension rod means attached at one end to said interconnecting arm means at one of a plurality of points thereon, and at the other end, to the first end of said lever assembly.

6. The weight exercise device as defined in claim 5 wherein said operator holding means defines handle means operably attached to said lever assembly second end.

7. The weight exercise device as defined in claim 6 wherein said operator holding means additionally defines chain means interposed said handle means and said lever assembly second end.

8. In a weight exercise device for attaching to and use with a weight-lifting bench, the combination comprising a pair of upright, elongated, and spaced apart parallel legs attached to the weight-lifting bench by bracket means, said pair of upright legs further defining angularly extending leg extension means attached at the top thereof; a lever assembly having a first and second end, and a transverse cross-bar, said cross-bar pivotally attached to said leg extension means; a weight holding assembly having a weight holding means and pivotal means, and interconnecting arm interposed said weight holding means and said pivotal means, said pivotal means operably attached to said pair of upright legs, and said interconnecting arm attached to said lever assembly first end; and an operator holding means operably attached to the second end of said lever assembly, said operator holding means defining a handle and chain, said chain attached at one end to said lever assembly second end, and the chain other end attached to said handle whereby the operator may rest on the weight-lifting bench, grasp the operator holding means handle and thereby move the weight holding assembly to perform exercises.

* * * * *